US007892116B2

(12) United States Patent
Kellogg

(10) Patent No.: US 7,892,116 B2
(45) Date of Patent: Feb. 22, 2011

(54) BASEBALL TRAINING AID

(76) Inventor: Norman Kellogg, 12862 Sylvan St., Garden Grove, CA (US) 92845

( * ) Notice: Subject to any disclaimer, the term of this patent is extended or adjusted under 35 U.S.C. 154(b) by 153 days.

(21) Appl. No.: 12/011,255

(22) Filed: Jan. 25, 2008

(65) Prior Publication Data

US 2008/0182686 A1 Jul. 31, 2008

Related U.S. Application Data

(60) Provisional application No. 60/897,662, filed on Jan. 26, 2007.

(51) Int. Cl.
*A63B 69/00* (2006.01)

(52) U.S. Cl. ..... 473/451; 473/422; 473/431

(58) Field of Classification Search ..... 473/422, 473/417, 431, 451, 453, 461; 463/1–4, 7–8, 463/36–38, 48–57
See application file for complete search history.

(56) References Cited

U.S. PATENT DOCUMENTS 4,461,477 A * 7/1984 Stewart ..... 473/453
4,699,379 A * 10/1987 Chateau et al. ..... 473/59
4,834,375 A * 5/1989 Elstein et al. ..... 473/417
5,419,549 A * 5/1995 Galloway et al. ..... 473/431
5,605,336 A * 2/1997 Gaoiran et al. ..... 273/445
6,304,665 B1 * 10/2001 Cavallaro et al. ..... 382/106
6,513,512 B2 * 2/2003 Battersby et al. ..... 124/78
6,695,723 B2 * 2/2004 Leal et al. ..... 473/417
7,536,033 B2 * 5/2009 Kirby ..... 382/107
2007/0078018 A1 * 4/2007 Kellogg et al. ..... 473/151
2007/0105664 A1 * 5/2007 Scheinert et al. ..... 473/461

* cited by examiner

*Primary Examiner*—Mitra Aryanpour
(74) *Attorney, Agent, or Firm*—Russo & Duckworth, LLP; David G. Duckworth

(57) ABSTRACT

A baseball training aid is provided which includes an audio or visual pitch indicator for simulating a baseball pitcher's pitch. The training aid further includes an impact sensor, preferably in the form of a microphone, for detecting whether a practicing batter's swing is timely, premature or late. The audio signals produced by the microphone are processed by a processor to determine the timeliness of the batter's swing. The results are then communicated to the batter using an audio or visual feedback indicator.

7 Claims, 5 Drawing Sheets

Total Elapsed time for the fast ball adjustment
880 msec - 1480 msec

Total Elapsed time for the off speed ball adjustment
1480 msec - 2180 msec

BASEBALL TRAINING AID

RELATED APPLICATIONS

This application is a continuation-in-part of U.S. provisional application Ser. No. 60/897,662 filed on Jan. 26, 2007.

BACKGROUND OF THE INVENTION

In the game of baseball, a batter or hitter stands at home plate and attempts to swing a bat in an effort to impact a ball that has been thrown by a pitcher. This pitcher can throw the ball at any speed and will attempt to throw the ball over home plate or "the hitting zone" at a height determined by the batter's physical size without the hitter striking the ball. A pitcher uses two techniques in order to throw the ball past the hitter; the first is pitch location. By varying the pitch location, the pitcher can get a batter to swing at a pitch not easily hit because of the pitch location. The second technique is speed. By altering the speed of a pitched ball, the pitcher can get a batter to swing early or late thereby missing impact as a ball crosses the hitting zone. Many tools have been used to train hitters on how to hit a pitched baseball and coaches use these tools in training players. Such tools include hitting tees, balls on sticks, hitting nets, balls that drop from tubes, and balls that shoot from machines. These devices attempt to help the hitter develop swing speed, feel of hitting a ball, hand-eye coordination, and a host of other motor skills necessary to impact a ball. One of the key pitching techniques used by pitchers is rarely addressed by any of the training devices on the market. Changing pitch speed is a critical technique used by pitchers and is very difficult to practice by the batter.

Swing timing is critical to becoming a good baseball hitter. A batter must train to produce a compact or quick swing. By developing a compact or quick swing, the batter has more time to discern if a pitch is in a good location and what speed it is traveling. Since a pitched ball traveling at 100 mph will take less than one-half (½) of a second to cover the distance between a pitcher's mound and home plate, swing time is critical to becoming a good hitter. A batter must also train to wait on a pitched ball. After a batter has developed a compact swing he must also train to wait. A pitcher will throw a series of pitches designed to fool a batter into swinging early or late. A common sequence would be to give a batter a series of fast pitches then throw a slow pitch to entice the batter to swing early. Batters must train themselves to recognize the pitch and wait until the correct moment to swing.

Other training techniques such as hitting machines attempt to address the timing issue but fall short of a realistic baseball experience because they are repetitious. A hitting machine will allow the user to change the speed of a pitched ball but only after a considerable amount of setup and test pitches. In an actual baseball game, a successful pitcher will mix pitches and change pitch speed from pitch to pitch, not allowing the batter to adjust and predict the timing of the next pitch. Baseball coaches will often times not want their batters to hit off of pitching machines because the batter will start timing the machine and create a swing that is tuned to make contact with a ball pitched at a particular speed. This creates a batter that is easily fooled by off-speed and changing pitch speeds. Advanced pitching machines that quickly change speeds and locations are very costly and large therefore not an option for coaches at the local ball field.

Hitting tees, another popular tool used by every baseball coach, are positioned in front of the batter and simply provide for positioning a ball on top of a post. The idea is for a batter to work on their bat speed and the feel of a good swing.

Unfortunately this tool does little to help with swing speed and timing issues inherent in an actual game of baseball and is best used just for the mechanics of the baseball swing. This tool, although valuable in one aspect of hitting, does little to help with timing.

Coaches have ultimately resorted to live pitching because only game situations can create a good practice environment. Live pitching is probably the best method of training but unfortunately is not a practical training method. The typical practice session on a baseball field consists of a coach pitching to a particular batter while eight other players stand around waiting their turn to hit. Combine this with the unfortunate reality that every pitch is not pitched in an accurate location and inevitably batters start swinging at bad pitches, a bad habit.

SUMMARY OF THE INVENTION

Briefly, in accordance with the invention, I provide an improved baseball training aid which attempts to artificially create the timing of a real baseball pitch as experienced in a game situation. The baseball swing training device precisely mimics the actual time it takes a pitch to travel from a pitcher's mound to home plate including some time for windup and delivery of the pitch. The training device also allows for one or more swing speeds to be preset so a batter cannot predict the timing of the next pitch and is forced to react as in a game situation.

The training device includes a timing microprocessor. Through the use of current electronic technology and microprocessors, the training device can precisely duplicate the timing of a pitched ball. The distance from a pitcher to a batter, although changing as a player becomes more advanced, is constant during different stages of a player's career. This distance, together with the known range of pitching speeds for baseball players, allows for the calculation of elapsed time from the start of a pitcher's windup to a ball entering the hitting zone. The timing microprocessor takes the preset speed information from two adjustable speed-setting inputs including one setting for fast range pitches and another for slower range pitches. The timing microprocessor incorporates audible and/or visual indicators, preferably in the form of one or more pattern generators that emit a series of indications (audio and/or visual) informing the batter that a pitcher's windup has started, and a pitch is on the way, and the relative speed of the pitch. Visual indicators may include blinking lights, such as those produced using LEDs, or even the visual display of a pitcher proceeding through his windup and pitch. Audible indicators may include a series of beeps or sounds that indicate a pitcher's windup has started, and a pitch is on the way, and the relative speed of the pitch.

Batters typically start their pre-swing motions as soon as or very soon after a pitcher starts their windup. The indication sequence is preferably a recognizable pattern so batters can time their swings easier. The indications are of constant duration but can have varying intervals according to the settings of the pitch speed adjustments. The objective of the player is to impact the ball at the occurrence of the target indication, preferably the last indication in the sequence.

An additional element of the training device is an impact sensor. As a player monitors the pitch indicators from the timing microprocessor and the pattern generator, he will attempt to strike the ball on the designated indicator (target indicator) or as the simulated pitch enters the hitting zone. The current invention assumes the ball is stationary and placed in a good hitting location for the batter to hit. Although another feature for this product is a programmable output designed to trigger an actual ball release from a ball projecting system. This ball projecting system can be a pitching machine of any kind, either electronic or gravity fed. The trigger output will be timed such that the ball crosses the hitting zone at precisely the same time as the occurrence of the target indication. In this fashion, the device can be used in conjunction with other training aids other than just a hitting tee. The impact sensor, preferably consisting of a microphone processing circuit, will detect impact of the ball with the bat and pass this information to the timing microprocessor. The impact sensor is designed to ignore any audible sounds emitted from the pattern generator. The timing microprocessor will then compare the occurrence of the target indicator to the occurrence of a sensed impact. Based on this timing relationship, the timing microprocessor will then display visual feedback or provide an audible response which includes the results of the batter's success in hitting a pitch as the ball would have passed through the hitting zone.

In order to make the device more realistic, the device can be set to, not only emit an indicator sequence consistent with either the fast range or slow range pitches, but also can be set using the mode switch to randomly mix the indicator sequences between the two settings. This feature insures batters do not predict the pitch speed before the pitch and are forced to react quickly and wait based on the pitch speed.

Preferably, the training device includes a scoring system developed to make the training device more competitive. Players often times develop games to play that help make training competitive and fun. To this end, the training device will calculate a player's success in hitting a ball in time and assign a point value for every sequence. This point value is tallied and displayed for a wide variety of games such as a ten-pitch game for not only tracking progress but also encouraging competition.

The invention may be constructed in various forms. For example, the electronics, including processor and audio and/or visual indicators may be housed within a compact mobile self-contained unit including a battery power source. Alternatively, the electronics may be packaged within a batting tee, thereby providing a platform for a ball to be struck. In still additional embodiments, the electronics may be provided in a video game such as provided at a video arcade or within a home computer or television gaming system.

Thus, it is an object of the present invention to provide a baseball swing training aid to assist a batter to develop a fast compact swing to be able to react in time to the simulated pitch.

It is an additional object of the invention to provide a training device which will display to the batter, based on their actual swing, where they contacted the ball in relation to the hitting zone or home plate.

It is still an additional object of the invention to provide an adjustable training aid that will change simulated speeds for baseball pitches which will thus simulate what a batter would experience in a game situation and force a batter to wait on slower pitches.

Further, it is an object of the invention that the baseball training device will keep score, display a batter's training progress, and allow the coach to track his or her performance.

These and other further and more specific objects and advantages of the invention will be apparent to those skilled in the art from a review of the following detailed description taken in conjunction with the drawings.

DETAILED DESCRIPTION OF THE INVENTION

Figure 1:
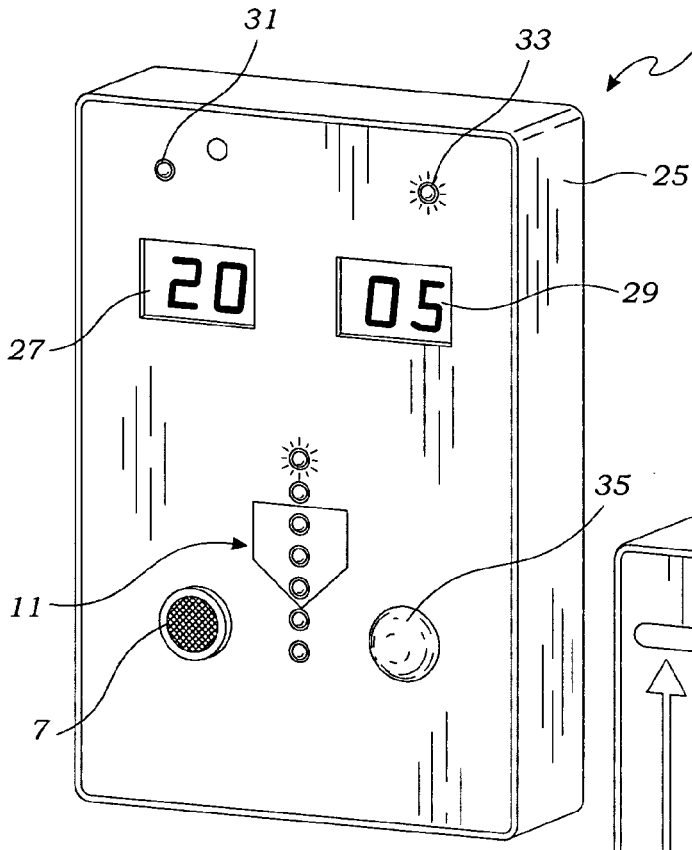
FIG. 1 is a front perspective view of the baseball training aid of the present invention.

While the present invention is susceptible of embodiment in various forms, as shown in the drawings, hereinafter will be described the presently preferred embodiments of the invention with the understanding that the present disclosure is to be considered as an exemplification of the invention, and is not intended to limit the invention to the specific embodiments illustrated.

Figure 5:
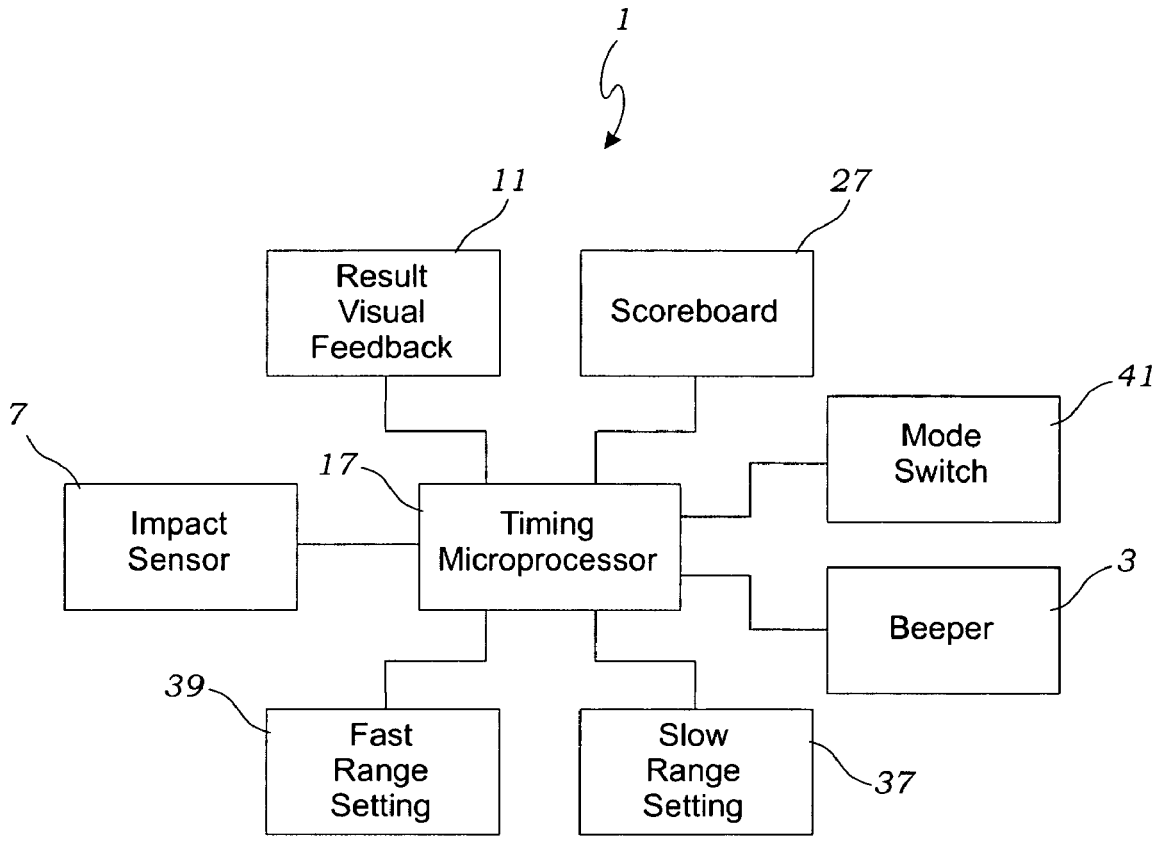
FIG. 5 is a graph illustrating the components of the baseball training aid of the present invention.

With reference to the figures, and particularly with reference to FIG. 5, the baseball training aid 1 of the present invention provides an audible or visual simulation of a baseball pitcher pitching a baseball. For purposes herein, the term "baseball" is intended to be interpreted extremely broadly such as to encompass variations in size such as smaller versions used by little leagues and larger sizes such as used for softball. The audio or visual simulator 3 may be presented in the form of a video display, flashing lights or presentation of sounds that a simulated pitch has both begun, which is typically referred to as a pitcher's windup, and the baseball pitch has been thrown. In a preferred embodiment, the pitch simulator 3 provides for a series of beeps, such as six beeps timed to sound like the common chant heard at sporting events ending with the word "charge". Preferably, the timing of the beeps can be modified to simulate various speeds of a pitch. For example, a preferred fastball pitch is simulated by a rapid six beep "charge", while a slow pitch is represented by a longer time span six beep "charge".

Figure 3:
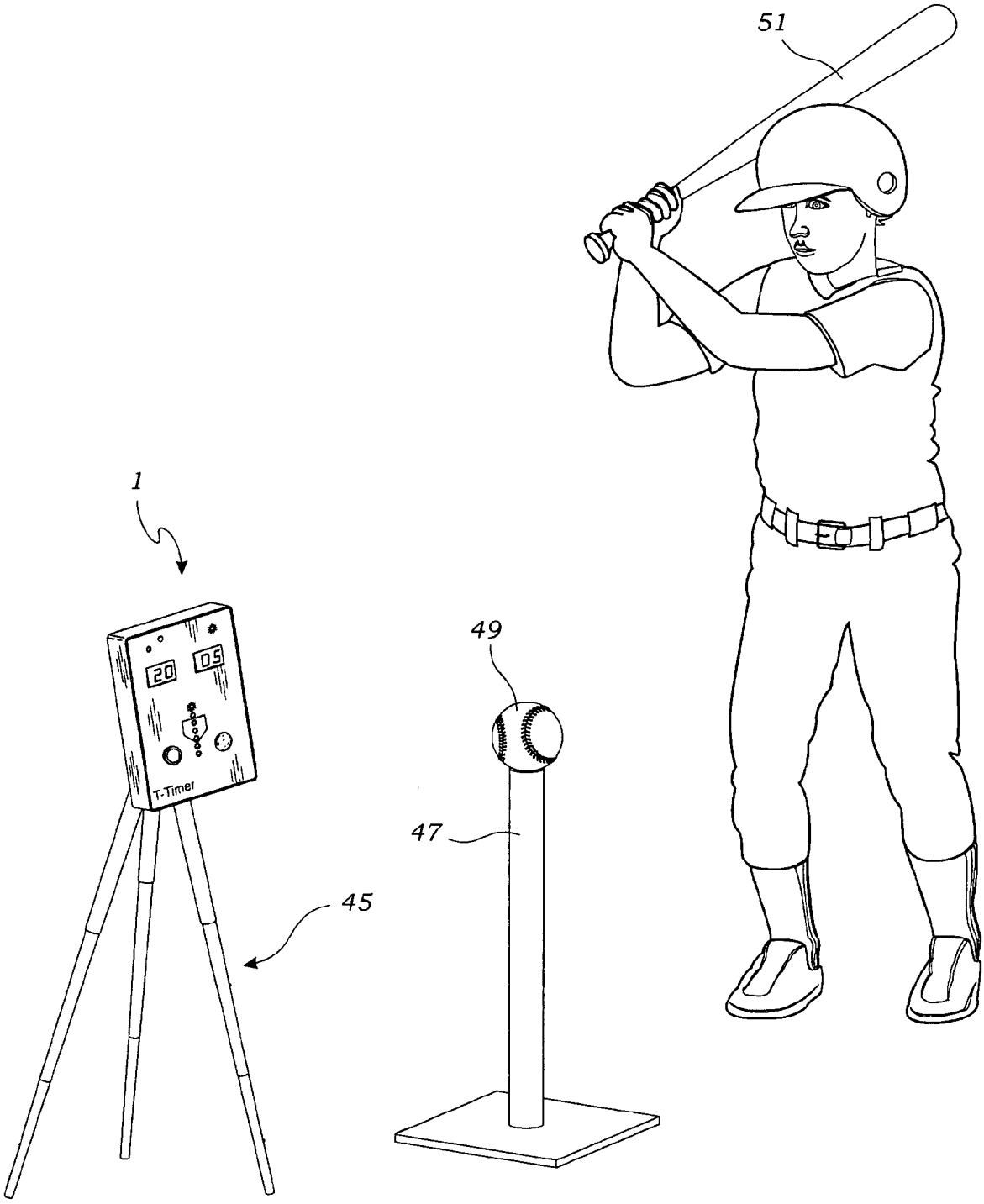
FIG. 3 is a perspective view of the baseball training aid of the present invention set up to include a baseball and tee for use by a batter.
Figure 4:
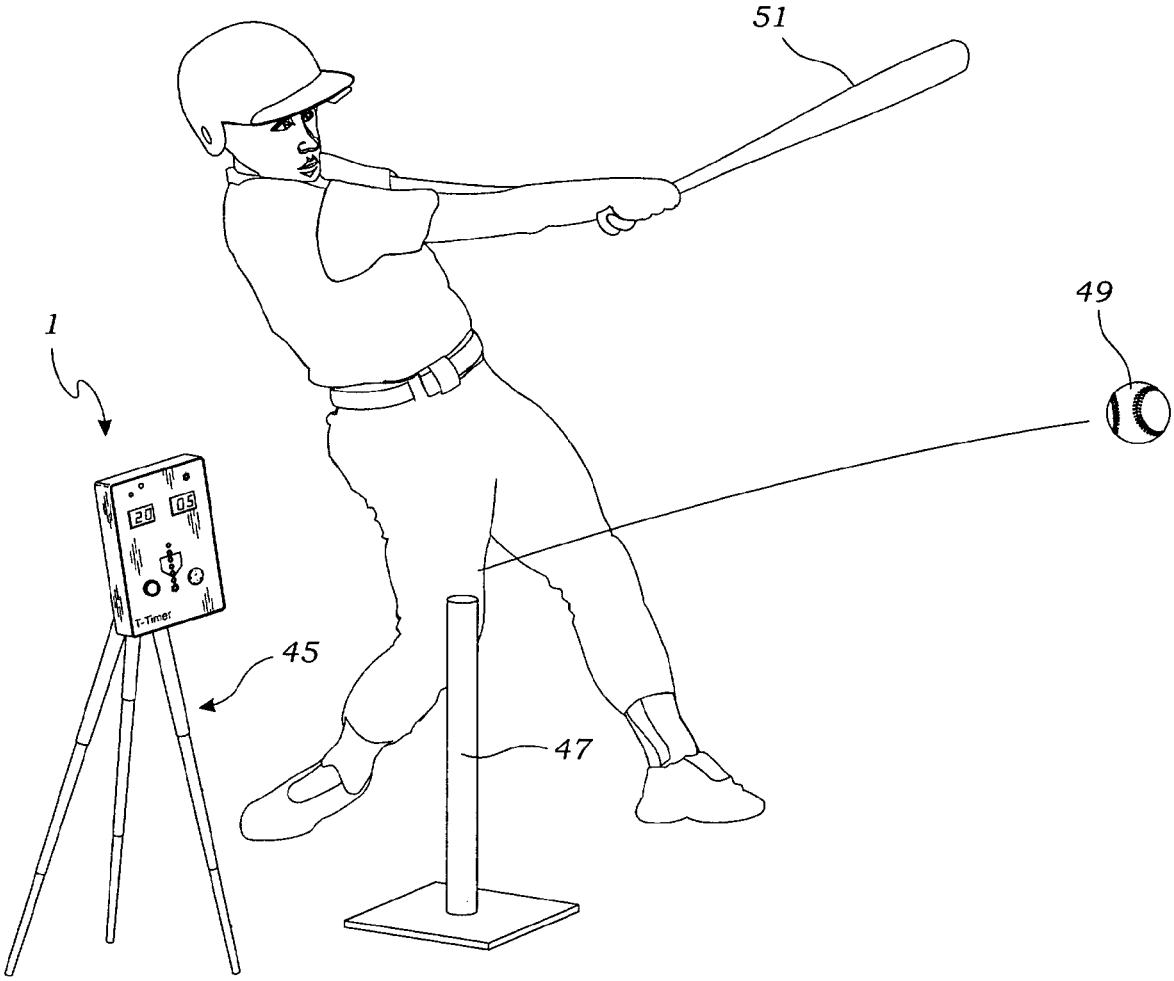
FIG. 4 is a perspective view of the baseball training aid of the present invention with a batter striking a ball off a tee.

As illustrated in FIGS. 3 and 4, the baseball training aid further preferably includes a tee 47 for holding a ball 49, as well as a bat 51 swung by a practicing batter. With reference again to FIG. 5, the baseball training aid 1 includes an impact sensor 7 for detecting when the batter's bat 51 has struck the ball 49. Preferably, the impact sensor is a microphone for receiving the audible "crack" sound produced by the bat 51 impacting the ball 49.

The baseball training aid 1 of the present invention further includes a microprocessor 17. The microprocessor performs numerous functions and may be embodied in a single microchip or may comprise several processing chips performing discreet functions. The processor is connected to the audio or visual indicator 3 which simulates that a baseball pitch has been thrown. The processor 17 triggers the activation of the baseball pitch simulator and selects whether the baseball pitch to be simulated is a fastball or slow pitch. The processor may also randomly select the speed of the pitch so as to change pitching speeds so as to make the simulated pitch more realistic for training.

The processor 17 is also connected to the impact sensor 7 for processing the output signals of the impact sensor. Preferably, the impact sensor is a microphone which transmits audio signals to the processor 17 for processing. Preferably, the processor includes audio filters and audio processing capabilities in the form of hardware or software for filtering out sounds not indicative of the "crack" sound of a bat impacting a ball and for determining whether a detected sound is a bat striking a ball.

The processor 17 further includes a timer for determining the time span between the first audio or visual indicator 3 simulating that a pitch has been thrown and the sound of a bat impacting a ball as detected by the impact sensor 7. The processor compares the detected time span with predetermined values reflecting the optimal time for a batter's swing. If the detected time span between the simulated pitch and the processor's determination that a bat has struck the ball is substantially the same as an optimal predetermined value, the processor determines that the batter has timely impacted the ball with his or her bat. Conversely, if the detected time span is less than or greater than the optimal predetermined value, the processor determines that the batter's swing has been premature or late. Of course, the predetermined values will vary depending on various factors including whether the simulated pitch is a fastball or slow pitch.

The determination by the processor 17 of whether the batter's swing is timely, premature or late is communicated to the practicing batter. To this end, the baseball training aid 1 includes an audio or visual feedback indicator 11 for communicating the timeliness of the batter's swing. The audio or visual feedback indicator may take various forms as would be understood by those skilled in the art. For example, the feedback indicator 11 may take the form of a speaker in which the timeliness of the swing may be communicated by prerecorded words such as "good swing", "late swing", or "way early". Alternatively, the feedback indicator 11 may take the form of various visual displays ranging from full video screens displaying a batter's swing in relation to an optimal simulated pitch. Still an additional embodiment of the feedback indicator comprises simple lights illuminating whether a batter's swing was timely, early or late.

Figure 2:
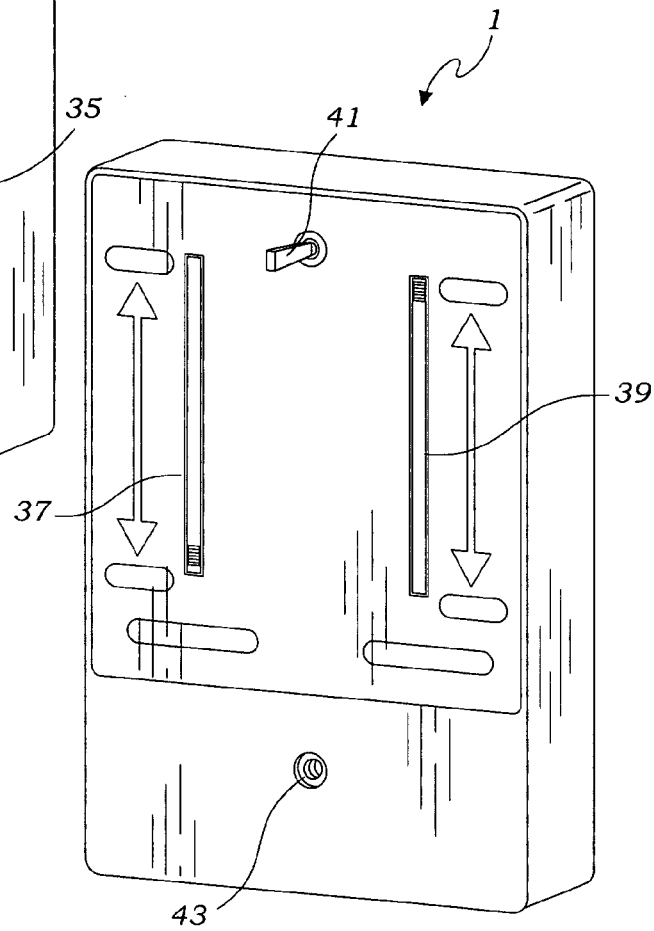
FIG. 2 is a rear perspective view of the baseball training aid of the present invention.
Figure 6:
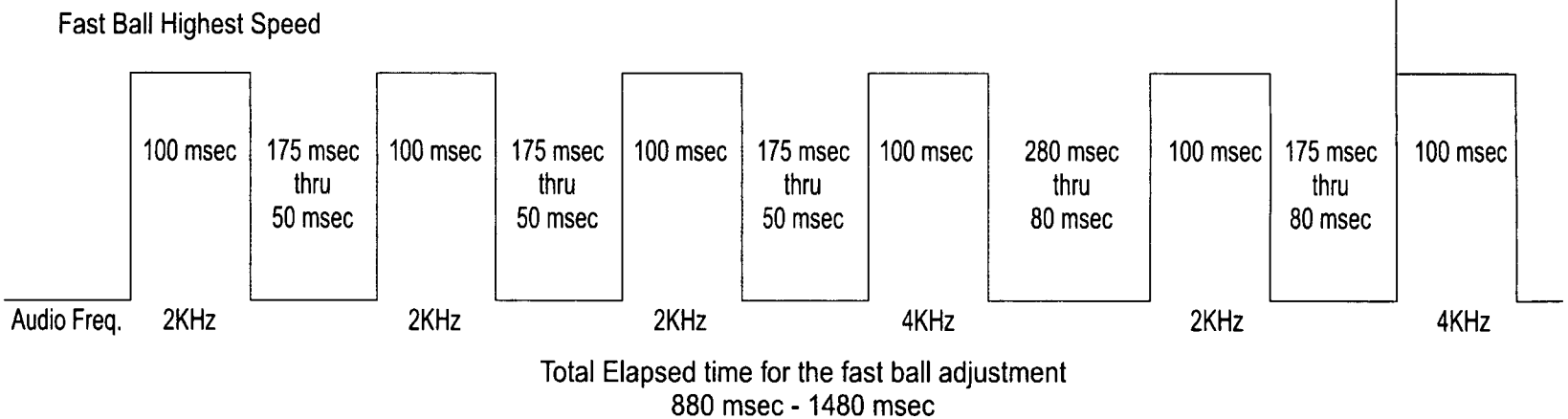
FIG. 6 is a chart illustrating the activation of an audio indicator for a simulated fastball pitch.
Figure 7:
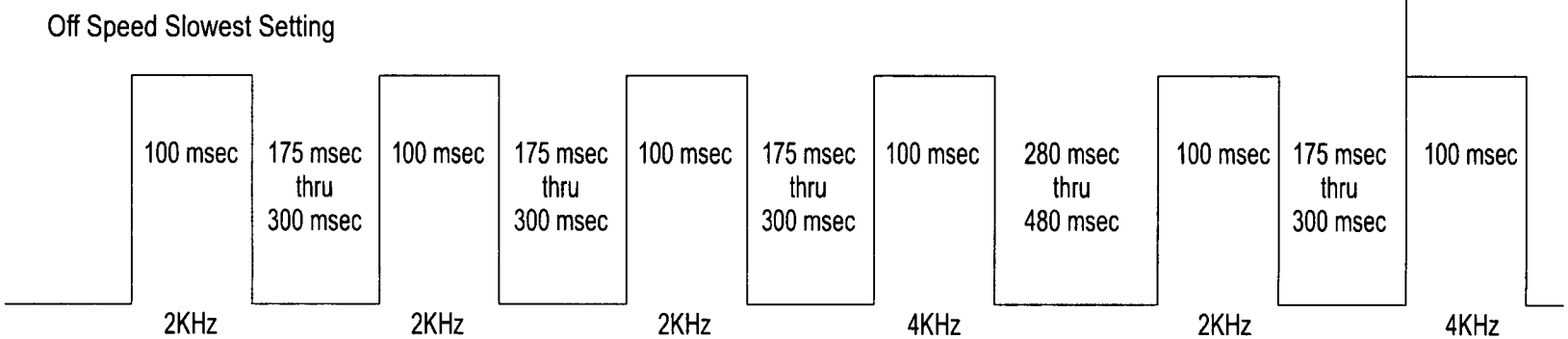
FIG. 7 is a chart illustrating the activation of an audio indicator for a simulated slow pitch.

The baseball training aid 1 of the present invention may be constructed in various forms. However, a preferred baseball training aid is illustrated in FIGS. 1-5 in which the training aid includes a housing for storing the various electronics including the pitch simulator 3 and feedback indicator 11. As illustrated in FIGS. 3 and 4, the baseball training aid 1 is preferably used by a practicing batter using a baseball tee 47, a baseball 49 and a baseball bat 51. As best illustrated in FIGS. 1 and 2, a preferred baseball training aid 1 includes various controls and audio and visual indicators. Preferably a reset button 35 is provided for signaling the processor to commence activation of the training aid. A speaker (not shown) transmits a series of six beeps to the tune of "charge". As illustrated in FIGS. 6 and 7, preferably the first beep signals that a pitcher windup has commenced with the beginning of the last beep signaling the optimal time for when the batter should strike the ball 49 with his bat 51. As illustrated in FIG. 6, the audible response for a fastball would be different than the audible response for a slow ball illustrated in FIG. 7. Though the sound of each beep will preferably remain the same, the time between beeps will diminish for a fastball with the batter understanding from hearing the first few beeps whether the pitch is a fastball, slow pitch or somewhere in between.

As illustrated in FIG. 2, preferably the baseball training aid 1 provides a first control 37 to allow a practicing batter to vary the simulated velocity, and corresponding time, of a slow pitch. In addition, it is preferred that the baseball training aid include a separate control 39 for controlling the time span, and accordingly the simulated velocity of a fastball pitch. Controls may take various forms. However, preferred controls illustrated in FIG. 2 are simple separate slide switches. The baseball training aid 1 may also include a light 31 for indicating that a fastball pitch is being simulated, and a separate light 33 for indicating that a slow pitch is being simulated.

As illustrated in FIGS. 1-3, the feedback indicator 11 for informing the practicing batter as to the timeliness of his or her swing preferably includes a series of lights in which each light indicates whether the batter's swing was timely, early or late. As shown, a preferred construction includes two lights which indicate that a batter's swing is very premature or premature, three lights for indicating that a pitched ball would have been over the plate when the batter swung, and two bottom lights for indicating that a batter's swing was late or very late.

In order to add additional playfulness and fun to the baseball training aid, preferably the training aid will play one or more games. To this end, preferably the processor 17 stores various gaming rules or criteria and a batter's performance is graded in accordance with these rules. For example, the accuracy of the swing may be graded and displayed, such as on a scoring display 27. Preferably, the baseball training aid will keep track of a practicing batter's swings and the number of swings are displayed on a pitch count display 29. Various games may be reset using the reset button 35. In addition, the practicing batter may selectively activate and deactivate the one or more games. Moreover, preferably the batter can select whether the simulated pitches are fastball pitches, slow pitches, or a variation of the two, such as by using a mode switch 41.

Still additional changes to the baseball training aid 1 may be made without departing from the spirit and scope of the invention. For example, the electronics may be prepackaged within a batting tee. Alternatively, the electronics may be packaged within a simple housing as illustrated in FIGS. 1 and 2, and then affixed to the end of a tripod using a mounting hole 43.

Having decribed my invention in such terms so as enabled persons skilled in the art to understand the invention, recreate the invention and practice, and having identified the preferred embodiments, I claim:

1. A baseball training aid comprising:

an audio or visual pitch indicator for simulating that a baseball pitch has been thrown;

a microphone for detecting the "crack" sound of a bat impacting a ball;

an audio or visual feedback indicator for indicating whether a person's bat impact was timely, premature or late;

a processor connected to said audio or visual indicators and said microphone, said processor triggering the activation of said audio or visual pitch indicator for simulating that a baseball pitch has been thrown, said processor including an audio filter for filtering out sounds not of the "crack" sound of a bat impacting a ball, said processor further including a timer for determining the time span between the audio or visual pitch indicator simulating that a pitch has been thrown and the "crack" sound of a bat impacting a ball detected by said microphone, said processor storing one or more predetermined time values reflecting the optimal time for the time span between the audio or visual pitch indicator simulating that a pitch has been thrown and the "crack" sound of a bat impacting a ball, said processor causing said audio or visual feedback indicator to indicate whether the person's bat swing was timely, premature or late based upon a comparison of the time span determined by the processor to the one or more predetermined values; and a housing with said audio or visual pitch indicator, said microphone, said audio or visual feedback indicator, and said processor located within said housing.

2. The baseball training aid of claim 1 further comprising a baseball, a tee for positioning said baseball, and a baseball bat for impacting said baseball.

3. The baseball training aid of claim 1 wherein said predetermined values include a first value representing a fastball pitch and a second value representing a slow pitch.

4. The baseball training aid of claim 3 wherein said audio or visual pitch indicator simulates whether the represented pitch is a fastball pitch or a slow pitch.

5. The baseball training aid of claim 4 wherein said processor randomly select a fastball pitch or slow pitch and causes said audio or visual pitch indicator to simulate a fastball pitch or a slow pitch according to the random selection.

6. The baseball training aid of claim 1 wherein said audio or visual pitch indicator provides separate indications of when a pitcher's windup has commenced and when the ball should optimally be impacted.

7. The baseball training aid of claim 4 wherein said audio or visual pitch indicator provides separate indications of when a pitcher's windup has commenced and when the ball should optimally be impacted.

* * * * *